US006640590B2

(12) United States Patent
Thoman et al.

(10) Patent No.: US 6,640,590 B2
(45) Date of Patent: Nov. 4, 2003

(54) CIRCULAR KNITTING MACHINE

(75) Inventors: Andreas Thoman, Bitz (DE); Pierre Jaeger, A-Hard (AU)

(73) Assignee: SIPRA Patententwicklungs- und Beteiligungsgesellschaft mbH, Albstadt (DE)

( * ) Notice: Subject to any disclaimer, the term of this patent is extended or adjusted under 35 U.S.C. 154(b) by 0 days.

(21) Appl. No.: 10/139,295

(22) Filed: May 3, 2002

(65) Prior Publication Data

US 2002/0166347 A1 Nov. 14, 2002

(30) Foreign Application Priority Data

May 9, 2001 (DE) ..... 101 23 089

(51) Int. Cl.[7] ..... D04B 15/88
(52) U.S. Cl. ..... 66/153
(58) Field of Search ..... 66/151, 149 R, 66/152, 8, 153, 147, 150

(56) References Cited

U.S. PATENT DOCUMENTS 3,105,283 A * 10/1963 Pernick ..... 26/87
3,718,300 A * 2/1973 Aronoff ..... 242/533.1
3,855,822 A * 12/1974 Lee ..... 66/147
4,314,462 A * 2/1982 Ducol et al. ..... 66/152
5,566,558 A 10/1996 Tsuchiya

FOREIGN PATENT DOCUMENTS

| | | |
|---|---|---|
| DE | 1 560 998 | 9/1969 |
| DE | 21 30 660 | 12/1972 |
| DE | 24 43 067 | 3/1975 |
| DE | 116 641 | 12/1975 |
| DE | 31 12 181 A1 | 1/1982 |
| DE | 691 21 291 T2 | 3/1997 |
| DE | 199 09 207 A1 | 9/2000 |
| EP | 0 003 697 A1 | 8/1979 |
| WO | 00/50678 | 8/2000 |

* cited by examiner

*Primary Examiner*—Danny Worrell
(74) *Attorney, Agent, or Firm*—Michael J. Striker

(57) ABSTRACT

A circular knitting machine for producing circular knitwear (15) is described, which is slit at one side, spread out with the aid of V-rolls (17) and then taken down and wound up in the spread out state. In accordance with the invention a guide element (44) if fitted at one end (33) of a fabric spreader (25) and extends up to a junction point (43) of the V-rolls (17). The knitwear (15) is guided by means of the guide element (44) in a controlled manner before running on to the V-rolls (17), such that backing-up and warping during its further transport are avoided.

13 Claims, 6 Drawing Sheets

CIRCULAR KNITTING MACHINE

BACKGROUND OF THE INVENTION

This invention relates to a circular knitting machine comprising means for producing circular knitwear, a fabric spreader with first and second ends arranged below said means, a take-down and/or winding-up device and a spreading out device which is arranged between said fabric spreader and said take-down and/or winding-up device and which includes V-rolls connected to one another at a junction point in V shape and a cutting device associated with said V-rolls such that a tubular section of said circular knitwear is laid flat by the fabric spreader, is slit by the cutting device along a longitudinal fold formed by the first end of said fabric spreader, is spread out by means of said V-rolls along a second longitudinal fold formed by the second end of said fabric spreader and is taken down in the spread out state by said take-down and/or winding-up device.

In conventional circular knitting machines knitwear of hose form is initially produced as a rule and is then put together as a double layer band and is fed in this form to a take-down and/or winding-up device and is finally wound up on a winding-up roller or otherwise taken off. In order to arrange that the hose goods are engaged and passed on by the take-down and/or winding-up device free from distortion and creases, a fabric spreader is as a rule arranged between the take-down device and the means producing the knitwear. The spreader comes to lie in the interior of the hose and is so shaped that the knitwear created essentially in a cylindrical form is pulled out wide in a radial direction at two diametrically opposite sides and is thus transformed into a substantially flat, double layer fabric band, before it gets into the region of action of the take-down and/or winding-up device. A disadvantage is that longitudinal folds or creases result at the two longitudinal sides of the double layer fabric band, which are permanently impressed in the fabric, especially when fine, elastic yarns are used, and cannot be removed in the finishing, even by specific finishing measures.

Circular knitting machines of the kind initially specified have therefore already been made known which take down and wind up a fabric slit along its longitudinal side and then opened out to double width, instead of the closed hose fabric coming from the machine (DE-T2-069 121 291, U.S. Pat. No. 5,566,558, WO-A 00/506 78). In such a case take-down and optionally also winding-up rollers are provided which have approximately twice the otherwise usual length and the machine diameter must in this case also be made substantially larger than is generally the case. An advantage of this form of machine is seen in that the two creases are obviated which arise when tubular knitwear is wound up.

However investigations with such circular knitting machines have shown that the cut and spread-out knitwear, when it comes from the machine, is distorted to an intolerable extent and creases form. More detailed investigations indicate that curved loop courses or stitch rows, respectively, in a middle region of the fabric are the cause of this distortion. The curving of the loop courses can for its part be caused by the fact that the fabric—as regarded over its width—is transported and fed to the take-down and/or winding-up device with a non-uniform speed in the region of the V-rolls being part of the spreading out device, so that take-down free from distortion and folds is not possible.

SUMMARY OF THE INVENTION

It is, therefore, an object underlying this invention to make possible a take-down of the knitted fabric without causing distortion and faults.

A further object of this invention to provide a circular knitting machine of the kind specified above for producing knitwear free from faults.

Another object of this invention is to design the circular knitting machine specified above in such a manner that a tubular portion of the knitwear is spread out in a manner which avoids the formation of curved loop courses.

Yet another object of the invention is to transfer the knitwear in the region of the V-rolls with a substantially uniform speed to the take-down and/or winding-up device.

These and other objects are solved in accordance with this invention by means of a guide element which is arranged between the second end and the junction point for transferring a region of the knitwear including the second longitudinal fold to the V-rolls.

The invention leads to the advantage that the previously observed warping in the spread-out fabric is largely avoided. This is attributed to the fact that the knitwear is also guided in the region located between the fabric spreader and the junction point of the V-rolls and can for example be kept at a radial distance from the machine axis which corresponds substantially to the radial distance produced by the fabric spreader. Thus the fabric is prevented from undesirable radial movements after leaving the fabric spreader up until the place where it runs on to the junction point of the V-rolls and transfers to the V-rolls without backing up.

BRIEF DESCRIPTION OF THE DRAWINGS

Further advantageous features of the invention appear from the dependent claims. The invention will now be explained in more detail with reference to an embodiment, in conjunction with the accompanying drawings, in which:

DESCRIPTION OF THE PREFERRED EMBODIMENT

Figure 1:
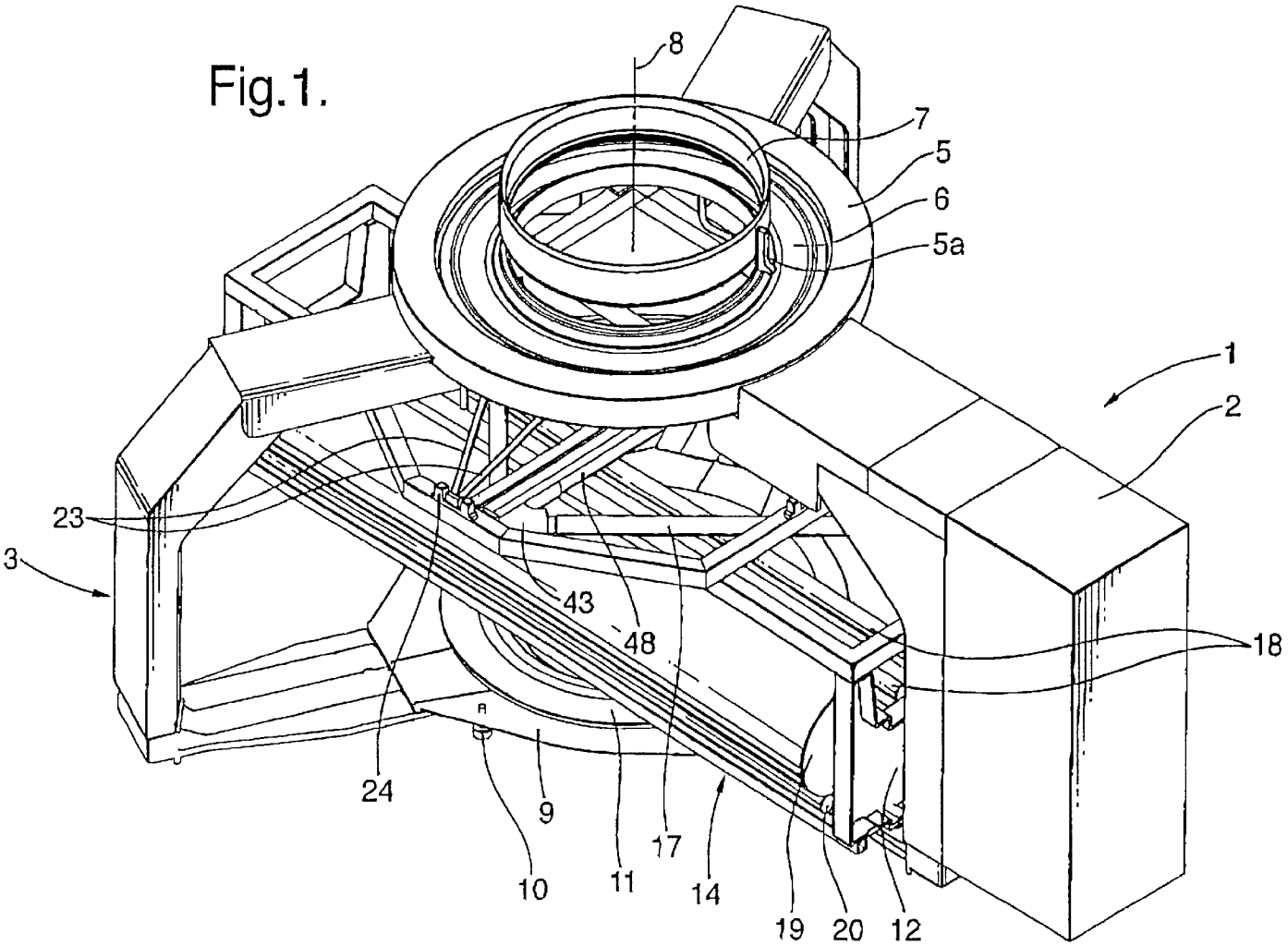
FIG. 1 is a schematic, perspective view of a circular knitting machine for producing slit and spread-out knitwear.
Figure 2:
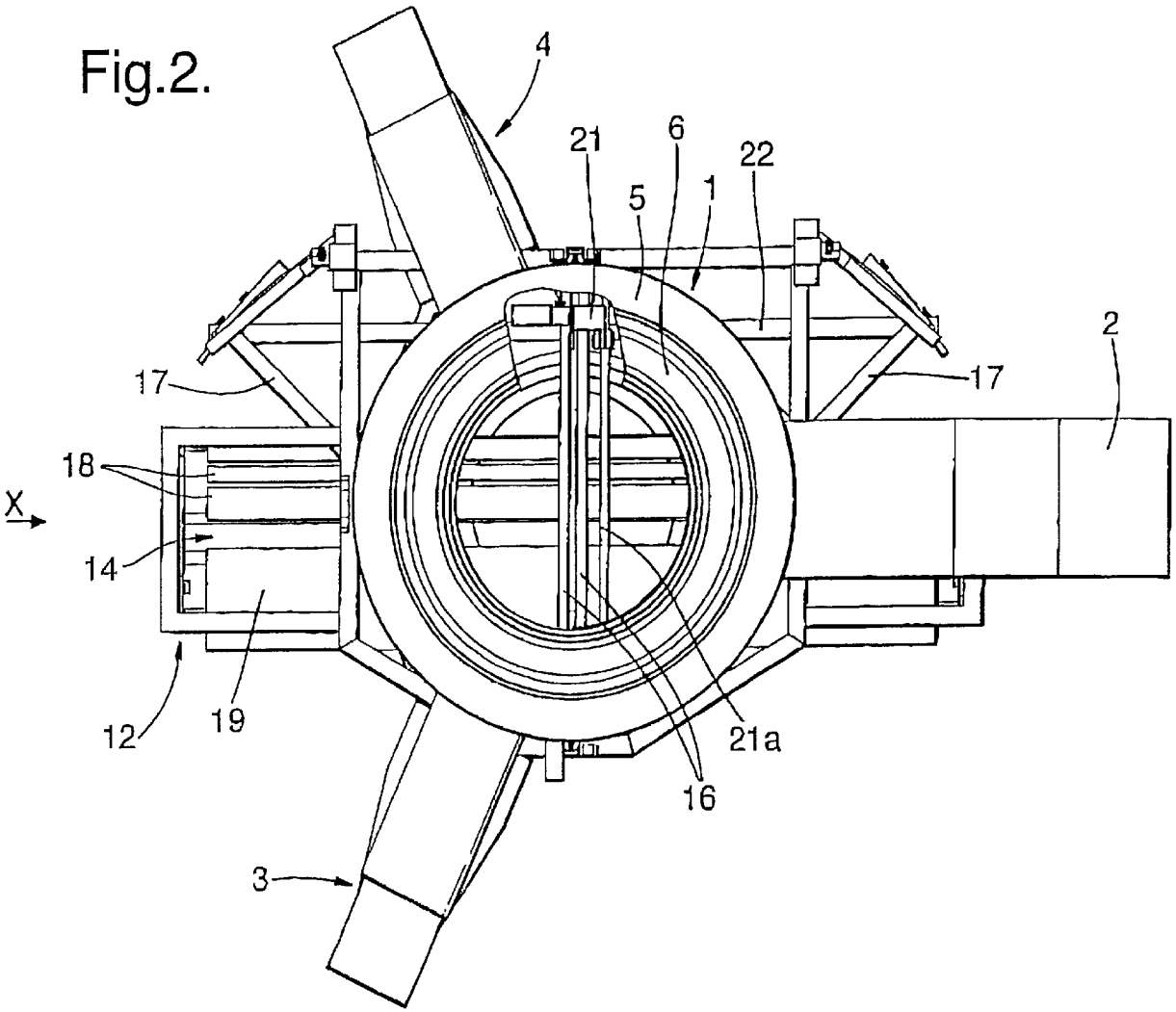
FIG. 2 is a plan view of the circular knitting machine according to FIG. 1.
Figure 3:
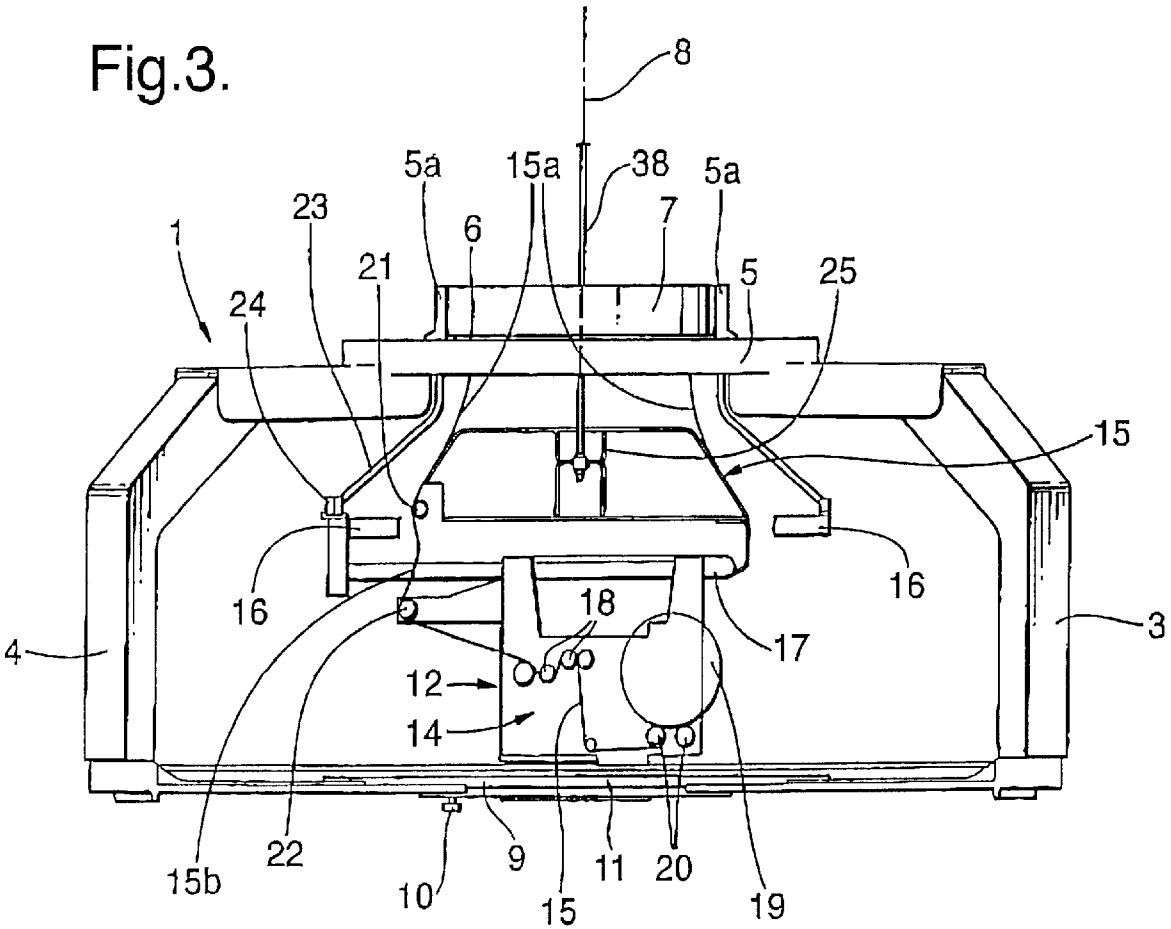
FIG. 3 is a side view of the circular knitting machine in the direction of an arrow x in FIG. 2.

According to FIGS. 1 to 3 a circular knitting machine comprises a frame 1, which has in the embodiment three feet 2 to 4 projecting radially out from the machine at angular spacings of about 120° each. The foot 2 is a main foot and each of the feet 3 and 4 is a side foot. The main foot 2 serves to receive a drive motor and other electrical and electronic assembles, not shown in detail, as well as operating elements for the circular knitting machine, while the side feet 3,4 are free from such installed units, apart from a switch unit optionally present.

The frame 1 further comprises an upper support ring 5, in which a carrier support ring 6 is rotatably mounted. A needle carrier 7 in the form of a needle cylinder, only schematically indicated, is fixed on the support ring 6 and is mounted to rotate in the frame 1 together with the carrier support ring 6 about a central or machine axis 8 of the circular knitting machine. The support ring 5 serves inter alia to receive a customary cam box ring surrounding the needle carrier 7, only one segment 5*a* thereof being shown for simplicity. The frame 1 moreover comprises a lower support ring 9, which can be rested on the ground with the aid of auxiliary feet 10. The lower support ring 9 serves to rotatably support a revolving plate 11, on which is fixed a frame 12 which carries a take-down and/or winding up device generally denoted by the reference numeral 14, by means of which knitwear 15 produced by the needle carrier 7 and indicated in FIG. 3 can be taken down and wound up. It is immaterial in principle whether the knitwear 15 is only taken down by the take-down and/or winding-up device 14, is only wound up and/or taken down and wound up, as is generally known to the man skilled in the art.

In the embodiment the frame 12 includes in its upper region two fixed or rotatably mounted deflecting bars 16, two fixed or rotatably mounted V-rolls 17 directly below these bars, preferably arranged substantially horizontally in a V-shape, for spreading out the knitwear, and below these V-rolls, in a middle part of the frame 12, two or more rotary take-down rollers 18 which rotate synchronously with the V-rolls 17, and finally a winding-up roller 19 mounted to rotate idly in the frame 12 in a lower section. At least one drive roller 20 bearing on its periphery is associated with the roller 19, in order to wind up knitwear 15 fed from the take-down rollers 18 on the winding-up roller 19 in known manner. Finally, the circular knitting machine comprises a cutting device 21 with a rotatable blade mounted in the frame 1, for the purpose of cutting open the knitwear 15 coming from the needle carrier 7 along a side line, after or optionally before passing the deflecting bars 16. The cutting device 21 is preferably slidably mounted on a bar 21*a,* in order to make it possible to adapt to different fabric widths. The V-rolls 17 can selectively be stationary or rotate and optionally be driven independently of the take-down rollers 18 with the aid of a separate rotary drive, e.g. a drive shaft.

In operation of the circular knitting machine the knitwear 15 coming from e needle carrier 7 is spread out by means of the V-rolls 17 along the cut line, until it forms a single-layer, substantially flat band and is then fed with the aid of a deflecting roller 22 (FIGS. 2 and 3) mounted rotatably in the frame 12 to the take-down rollers 18 and thence to the winding-up roller 19. It is then wound up by this with a width corresponding to twice the width of the double layer hose produced by the needle carrier 7 and normally folded along opposite side edges. It is immaterial whether the needle carrier 7 and the whole take-down and winding-up device 14 therewith rotate about the middle axis 8, with the aid of a drive fitted in the main foot 2, or whether both stay stationary and the cam box ring is rotated instead.

In case of a circular knitting machine with a rotatable needle carrier 7, at least one entraining device 23 is preferably provided on the underside of the carrier support ring 6. The entraining device 23 serves to rotate the frame 12 synchronously with the cylinder support ring 6 and is retained in a coupling receptacle 24 thereof.

As is shown in FIG. 3 in particular, a fabric spreader 25, also sometimes called "stretcher", is arranged within a tubular section 15*a* of the knitwear 15 produced by the means 5*a,* 6. The purpose of the spreader 25 is to transform the section 15*a* into a double-layer, flat fabric band 15*b,* which is fed in this form to the spreading out device including the V-rolls 17.

Circular knitting machines of this kind are generally known and therefore do not need to be explained to the man skilled in the art in more detail (DE-T2 691 21 291, U.S. Pat. No. 5,566,558, WO-A 00/506 78). The same applies to the numerous possible embodiments of the fabric spreader and its arrangement in the circular knitting machine (e.g. DE-A 2 130 660, DE-A 2 443 067, DE-A 3 112 181, DE-A 199 09 207), for which reason all these documents are, for the avoidance of repetition, made part of the present disclosure of the subject matter by reference.

Figure 4:
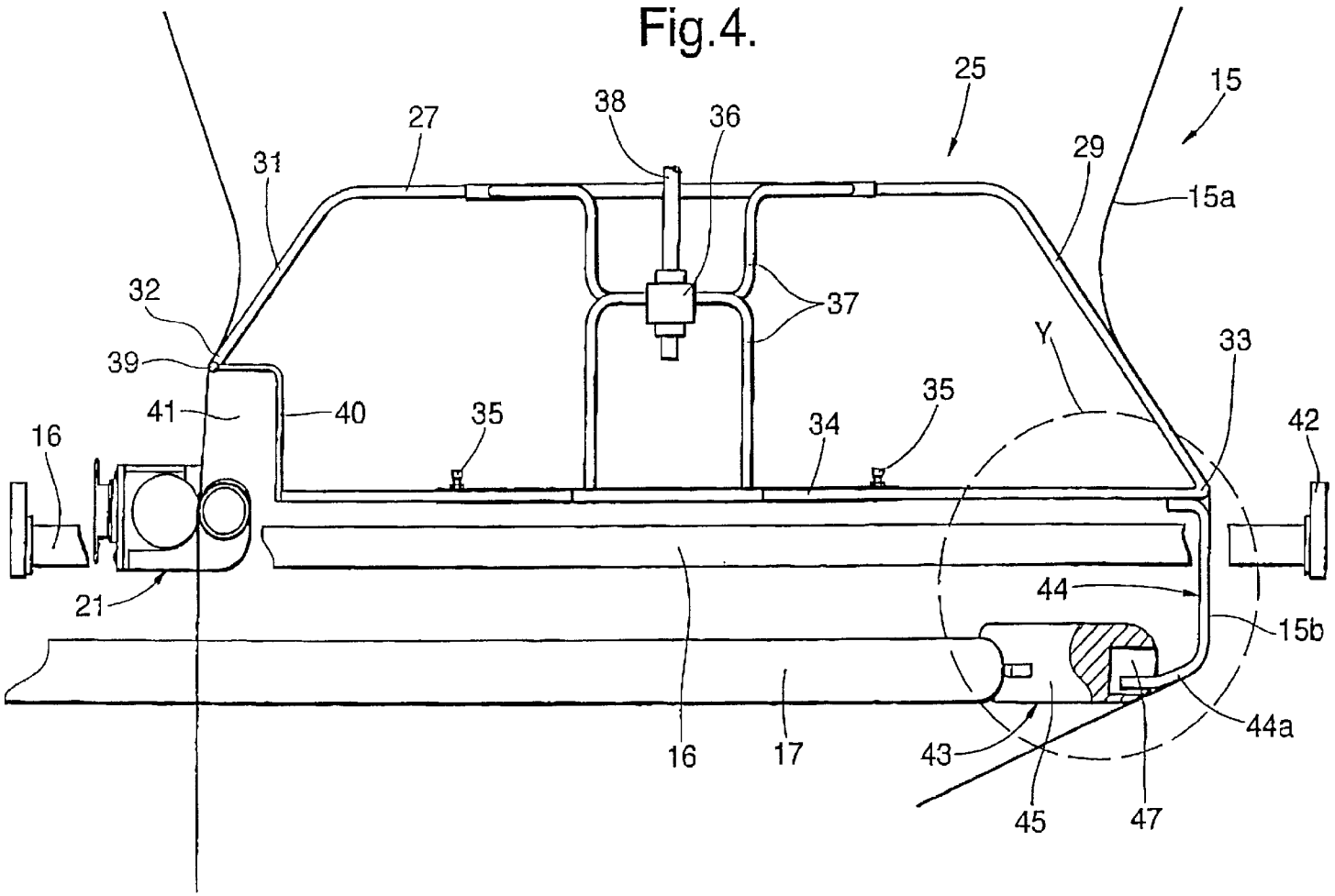
FIG. 4 shows a fabric spreader and a spreading out device of the circular knitting machine according to FIGS. 1 to 3 to a larger scale.
Figure 5:
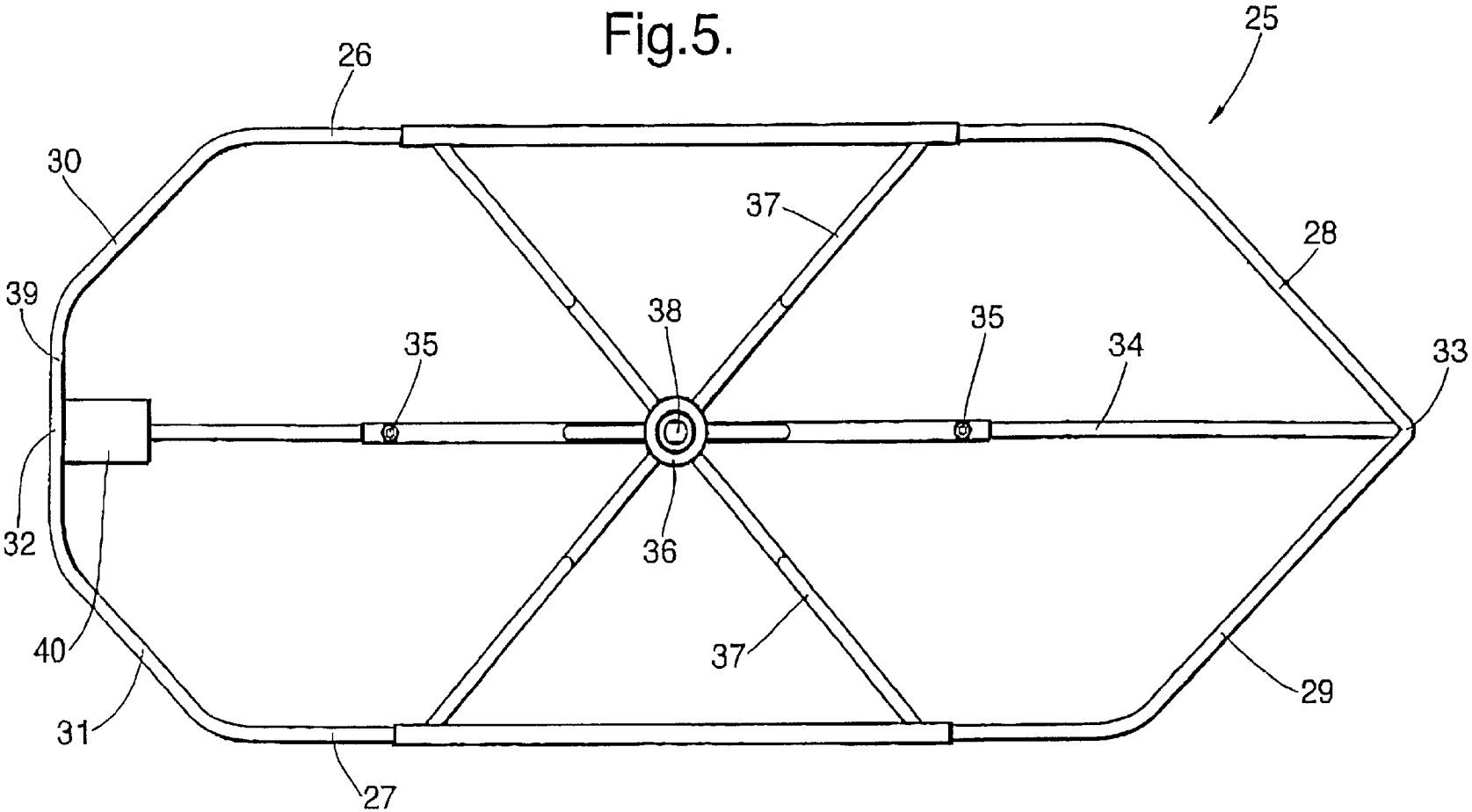
FIG. 5 is plan view of just the fabric spreader according to FIG. 4.

The shape of the fabric spreader 25 used according to an embodiment of the invention deemed to be the best one up to now, appears in particular from FIGS. 4 and 5. The fabric spreader 25 includes two parallel, comparatively long bars 26 and 27 arranged in an upper plane, at whose ends are fixed comparatively short rods 28 to 31 respectively extending obliquely downwards. The rods 28, 29 and 30, 31 moreover converge in pairs in a triangular shape and are so connected together in pairs at their free ends that the points of connections form respective first and second ends 32, 33 which lie in a lower plane of the fabric spreader 25 parallel to the upper plane. The spacing of the ends 32, 33 characterizing the length of the fabric spreader 25 is therefore comparatively large in relation to the spacing of the upper rods 26, 27 measured perpendicular to the length and corresponding to the width of the fabric spreader 25.

The two ends 32, 33 are moreover joined by a rod 34. The rod preferably consists, like the rods 26, 27, of e.g. three sections slidable relative to one another telescopically, which can be fixed relative to one another by means of adjusting screws 35. The length of the fabric spreader 25 can thus be altered by loosening the adjusting screws 25, sliding the sections and then tightening up the adjusting screws 35 again. A rotary berg 36, e.g. in the form of a sleeve, is moreover arranged in the centre of the fabric spreader 25 and is fixed with the aid of connecting arms 37 to the rods 26, 27 and optionally 34 and serves to receive a support rod 38 rotatably. This can be fixed in a manner known per se to a positionally fixed part of the circular knitting machine, coaxial with the machine axis 8 (FIG. 3), e.g. on a central, middle bar which passes through the needle carrier 7 and is fixed on a spider supported on the support ring 5, above the needle carrier 7. The fabric spreader 25 is thereby mounted rotatably on the support rod 38. Means, not shown, are preferably also provided for adjusting the height of the fabric spreader 25.

The rods 30, 31 at the left end in FIGS. 4 and 5 of the fabric spreader 25 preferably end short of a conceptual triangle apex. They are connected at their free ends by a transverse rod 39 which forms the end 32 in this case and is fixed in a middle section by an angled piece 40 aligned radially inwards and downwards. A recess 41 thus results at the first end 32, in which the cutting device 21 also shown in FIGS. 2 and 3 can at least partially project. Alternatively, the end 32 can be formed just like the end 33 and the cutting device 21 be arranged entirely below the fabric spreader 25. Moreover the blade of the cutting device could project between the bars 30, 31.

In FIG. 4 the relative position of the deflecting bas 16 and V-rolls 17 described with reference to FIGS. 1 to 3 can also be seen to a larger scale, their axes lying substantially in planes which are arranged parallel to the upper and lower planes of the fabric spreader 25. Accordingly the hose or tubular section 15*a* of the knitwear 15 fed to the region of the upper bars 26, 27 is stretched by the fabric spreader 25 in the direction of the ends 32, 33 and is simultaneously drawn together transverse to this direction, so that it is laid flat on leaving the fabric spreader 25 and forms a fabric band 15*b* which consists of two layers connected along lateral longitudinal folds. This fabric band 15*b* is then fed, as described, through a narrow gap formed between the deflecting bars 16, slit continuously at a lateral longitudinal fold by the cutting device 21 and spread out with the aid of the V-rolls 17. The deflecting bars 16 are fixedly or rotatably mounted by means of bearings 42.

In order that the knitwear 15 is constantly guided in a controlled manner in the region between the second end 33 and a junction point 43 of the two V-rolls 17, a guide element 44 is arranged in this region in accordance with the invention. The guide element 44 is a rod for example, especially a round rod, and is fixed at one end to the underside of the second end 33 of the fabric spreader 25. The guide element 44 preferably projects down from this substantially parallel to the machine axis 8 (FIG. 3), its outer radial spacing from the machine axis 8 preferably being the same as the radial spacing of the outer surface of the end 33 from the machine axis 8, down to close to the junction point 43. At the height of the junction point 43 the guide element 44 is bent or curved radially inwards along a section 44*a* and extends up to the junction point 43, so that a radially outer guide surface of the guide element 44 there forms a gentle transition region, free from steps, up to the start of the V-rolls 17. In principle it is immaterial whether the two deflecting bars 16 are additionally present or not. If the deflecting bars 16 are present, which is advantageous, then the guide element 44 is to be made at least thin enough to be able to project through the gap between the deflecting bars, as FIG. 4 shows.

Figure 6:
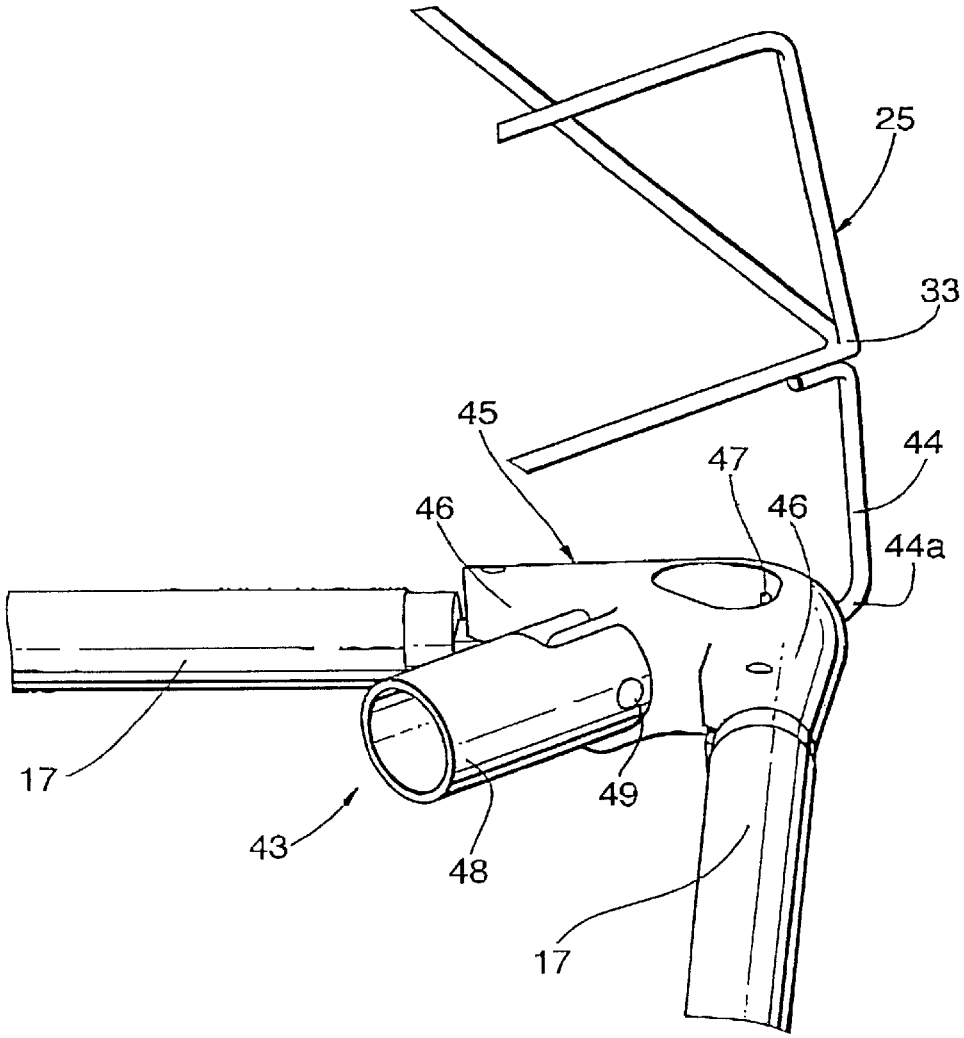
FIG. 6 is an enlarged, perspective view of a detail Y in FIG. 4.

The junction point 43 between the V-rolls 17 is formed by an end-piece 45 according to a preferred embodiment of the invention (FIG. 6). This has two extensions 46 on a radially inner side facing the machine axis 8, each of which can receive an end of an associated V-roll 17. The V-rolls 17 can be fixed as required rotatably and/or pivotally and/or non-rotatably, with the aid of fixing screws, not shown, on the extensions 46. The end-piece 45 moreover preferably has a recess 47 on a radially outer side for reception of the associated, radially inwardly bent end 44*a* of the guide element 44. This results in the additional advantage that the guide element 44 is formed as an entraining device, which transmits to the fabric spreader 25 rotary movement of the whole spreading-out device about the machine axis 8, which is necessary with use of a circular knitting machine with a rotating needle cylinder, so that the spreader does not have to be rotated about the support rod 38 by the knitwear 15 itself or by an additional coupling element.

The end-piece 45 is preferably fixed according to FIG. 6 on the free end of a stable rod or tubular element 48, which is fixed to a radially opposite part of the frame 12, as FIG. 1 shows. It is particularly advantageous if the rod or tube element 48 and the end-piece 45 have associated connecting elements which can be brought into engagement, e.g. in the nature of hinge connections having a substantially horizontally disposed tilting axis and a clamping screw 49. It is then possible, after slackening the clamping screw 49, to adjust the angle of tilt of the V-rolls 17 rollers relative to the rod or tube element 48, depending on the current requirements, and then to tighten the clamping screw up again. It would further be possible to mount the V-rolls 17 by means of the extensions 46 in a corresponding manner, such that the angle subtended by them can be altered. Finally the V-rolls can be arranged so that they can turn and/or pivot according to requirements in a different way.

A particularly significant advantage of the guide element 44 lies in that it can be made comparatively thin. Best results have been achieved up to now for example with a round rod of 9 mm maximum thickness, whose bent over end 44*a* has a length of 77 mm. However diameters of the guide element 44 from 2 mm to 40 mm for example can also be used. Because of this construction it is possible to make the end-piece 45 formed as a knee comparatively wide transverse to the gap between the deflecting bars 16, even when this gap is chosen very narrow. As FIG. 4 for example shows, the fabric laid flat is, in accordance with the invention, spread not by the end-piece 45 but by the thinner guide element 44 and is only then transferred to the V-rolls 17. This avoids the danger that the knitwear 15 folded closely together by the fabric spreader 25 and optionally also by the deflecting bars 16 has to run abruptly on to the wide end-piece 45 or any other construction used to join the V-rolls 17 together, and is thereby under some circumstances prevented from a uniform advance taking place under the action of the take-down and/or winding-up device 14. The thinner or narrower the guide element 44, the more uniformly the spreading out operation will presumably take place. This applies especially when the straight section of the guide element 44 depending from the fabric spreader 25, in accordance with FIG. 6, is arranged radially substantially at a place which corresponds to a conceptual point of intersection of the two central axes of the V-rolls 17, such that there is a sufficiently large radial spacing from thence up to the junction point 43 or up to the end-piece 45. The folded knitwear 15 can then be spread out gradually over a longer path, without undesirable backing-up or other chances in speed in the running of the knitwear 15 on to the junction point 43.

The invention is not limited to the described embodiments, which can be modified in numerous ways. This applies especially to the design and arrangement of the guide element 44 from which an embodiment deemed to be the best one up to now is shown in FIGS. 4 to 6. Element 44 can for example be formed as a rod which has a preferably round or oval fabric guide surface on its radially outer side only. It would further be possible for the guide element 44 not to maintain exactly the maximum width of the knitwear 15 created by the fabric spreader 25 right up to the vicinity of the junction point 43. Such arrangements in particular are advantageous as make it possible to adjust the guide element 44 in the radial and/or axial direction and thus facilitate production of a position of the guide element 44 which is found to be the most favourable, depending on the specific case. Furthermore it is clear that the guide element 44 should be made from a material which ensures good friction properties in relation to the yarn used for the production of the knitwear 15. The invention is furthermore not limited to the described indications of dimensions for the guide element 44, which are only to be regarded as examples. The needle carrier 7 could be in the form of a dial instead of a needle cylinder or have a dial in addition to the needle cylinder. Finally it will be understood that the various features can be used in combinations other than those illustrated and described.

It will be understood that each of the elements described above, or two or more together, may also find a useful application in other types of circular knitting machines differing from the types described below.

While the invention has been illustrated and described as embodied in a circular knitting machine, it is not intended to be limited to the details shown, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new is set forth in the following appended claims.

What is claimed is:

1. A circular knitting machine, comprising: means (5*a,* 7) for producing circular knitwear (15), a fabric spreader (25) with first and second ends (32, 33) arranged below said means (5*a,* 7), a take-down and/or winding-up device (14) and a spreading out device being arranged between said fabric spreader (25) and said device (14) and including V-rolls (17) connected to one another at a junction point (43) in V shape and a cutting device (21) associated with said V-rolls, such that a tubular section (15*a*) of said circular knitwear (15) is laid flat by said fabric spreader (25), is slit by said cutting device (21) along a longitudinal fold formed by said first end (32) of said fabric spreader (26), is spread out by means of said V-rolls (17) along a second longitudinal fold formed by said second end (33) of said fabric spreader (25) and is taken down in a spread out state by said device (14), and a guide element (44) extending from said second end (33) to said junction point (43) for transferring a region of said knitwear (15) including said second longitudinal fold to said V-rolls (17).

2. A circular knitting machine according to claim 1, wherein said guide element (44) comprises a rod.

3. A circular knitting machine according to claim 2, wherein said rod is provided with a fabric guide surface of round shape.

4. A circular knitting machine according to claim 2 wherein said rod is provided with a fabric guide surface of oval shape.

5. A circular knitting machine according to claim 1, wherein said guide element (44) is designed as an entraining device which transfers rotary movements of said V-rolls (17) about said machine axis (8) to said fabric spreader (25).

6. A circular knitting machine according to claim 1, wherein said junction point (43) is formed by an end-piece (45) which has two extensions (46) on a radially inner side for reception of ends of said V-rolls (17).

7. A circular knitting machine according to claim 6, wherein said V-rolls (17) are mounted rotatably in said end-piece (45).

8. A circular knitting machine according to claim 6, wherein said V-rolls (17) are pivotally mounted in said end-piece (45).

9. A circular knitting machine according to claim 6, wherein said end-piece (45) is provided on a radially inner side with a receptacle (47) for an associated end of said guide element (44).

10. A circular knitting machine according to claim 1, wherein two deflecting bars (16) forming a gap for passage of said knitwear (15) are arranged between said fabric spreader (25) and said V-rolls (17) and in that said guide element (44) projects through said passage gap.

11. A circular knitting machine, comprising: means (5*a,* 7) for producing circular knitwear (15), a fabric spreader (25) with first and second ends (32, 33) arranged below said means (5*a,* 7), a take-down and/or winding-up device (14), a spreading out device being arranged between said fabric spreader (25) and said device (14) and including V-rolls (17) connected to one another at a junction point (43) in V shape and a cutting device (21) associated with said V-rolls, such that a tubular section (15*a*) of said circular knitwear (15) is laid flat by said fabric spreader (25), is slit by said cutting device (21) along a longitudinal fold formed by said first end (32) of said fabric spreader (26), is spread out by means of said V-rolls (17) along a second longitudal fold formed by said second end (33) of said fabric spreader (25) and is taken down in a spread out state by said device (14), and a guide element (44) extending from said second end (33) to said junction point (43) for transferring a region of said knitwear (15) including said second longitudinal fold to said V-rolls (17), wherein said guide element (44) is fixed on said second end (33) of said fabric spreader (25) and is arranged substantially parallel to a machine axis (8) and at a radial distance from said axis (8) which corresponds to a radial distance of said second end (33) from said machine axis (8).

12. A circular knitting machine, comprising: means (5*a,* 7) for producing circular knitwear (15), a fabric spreader (25) with first and second ends (32, 33) arranged below said means (5*a,* 7), a take-down and/or winding-up device (14), a spreading out device being arranged between said fabric spreader (25) and said device (14) and including V-rolls (17) connected to one another at a junction point (43) in V shape and a cutting device (21) associated with said V-rolls, such that a tubular section (15*a*) of said circular knitwear (15) is laid flat by said fabric spreader (25), is slit by said cutting device (21) along a longitudinal fold formed by said first end (32) of said fabric spreader (26), is spread out by means of said V-rolls (17) along a second longitudal fold formed by said second end (33) of said fabric spreader (25) and is taken down in a spread out state by said device (14), and a guide element (44) extending from said second end (33) to said junction point (43) for transferring a region of said knitwear (15) including said second longitudinal fold to said V-rolls (17), wherein said guide element (44) comprises a rod and said rod is provided with a fabric guide surface of oval shape, and wherein said guide element (44) provides a transition without a step and runs approximately at a height of said junction point (43) along a radially incurved acr (44*a*) up to the junction point (43).

13. A circular knitting machine, comprising: means (5*a,* 7) for producing circular knitwear (15), a fabric spreader (25) with first and second ends (32, 33) arranged below said means (5*a,* 7), a take-down and/or winding-up device (14), a spreading out device being arranged between said fabric spreader (25) and said device (14) and including V-rolls (17) connected to one another at a junction point (43) in V shape and a cutting device (21) associated with said V-rolls, such that a tubular section (15*a*) of said circular knitwear (15) is laid flat by said fabric spreader (25), is slit by said cutting device (21) along a longitudinal fold formed by said first end (32) of said fabric spreader (26), is spread out by means of said V-rolls (17) along a second longitudal fold formed by said second end (33) of said fabric spreader (25) and is taken down in a spread out state by said device (14), and a guide element (44) extending from said second end (33) to said junction point (43) for transferring a region of said knitwear (15) including said second longitudinal fold to said V-rolls (17), wherein said first end (32) of said fabric spreader (25) has a recess(41) into which said cutting device (21) projects.

* * * * *